US005519909A

United States Patent [19]

Fuessinger

[11] Patent Number: 5,519,909

[45] Date of Patent: May 28, 1996

[54] TROUGH BRIDGE COMPRISING NESTABLE MODULES

[75] Inventor: Reinhold Fuessinger, Friedrichshafen, Germany

[73] Assignee: Dornier GmbH, Germany

[21] Appl. No.: 305,659

[22] Filed: Sep. 14, 1994

[30] Foreign Application Priority Data

Sep. 15, 1993 [DE] Germany ..... 43 31 254.3

[51] Int. Cl.[6] ..... F01D 15/12

[52] U.S. Cl. ..... 14/2.4

[58] Field of Search ..... 14/2.4, 4, 5, 8, 14/14, 20; 52/79.5

[56] References Cited

U.S. PATENT DOCUMENTS 3,239,862 3/1966 Hire ..... 14/2.4
4,635,311 1/1987 Helmke ..... 14/77.1 X
5,152,109 10/1992 Boers ..... 52/79.5 X
5,173,981 12/1992 Hasselkvist ..... 14/2.4

FOREIGN PATENT DOCUMENTS

0290405A1 11/1988 European Pat. Off. .
1365143 10/1963 France .

*Primary Examiner*—William P. Neuder
*Attorney, Agent, or Firm*—Evenson, McKeown, Edwards & Lenahan

[57] ABSTRACT

A trough bridge is provided with a plane roadway and upward extending side walls. Top chords are arranged on the upper ends of the side walls. The bridge can be divided along the roadway into an arbitrary number of modules, the length of which may be adapted to the available transport length. The individual bridge modules may be nested in each other for transport such that a stack with a very small transport height results.

8 Claims, 5 Drawing Sheets

TROUGH BRIDGE COMPRISING NESTABLE MODULES

BACKGROUND AND SUMMARY OF THE INVENTION

The present invention relates to a trough bridge with a plane roadway and upward extending side walls of the type generally disclosed in European Patent No. 0,290,405 A1.

An object of the present invention is to provide a bridge which may be stacked or nested together for transport purposes such that the smallest possible transport dimensions are attained.

This object has been attained in accordance with the present invention by a bridge which is constructed of individual modules which can be nested on each other so as to result in a stack with the smallest practical height.

The bridge according to the present invention is a trough bridge with a plane roadway situated on the bottom and into which the bottom chords are integrated, and with upward extending side walls on whose upper ends are arranged the top chords of the supporting structure.

The bridge of the present invention is dividable longitudinally into an arbitrary number of modules, the length of which may be adapted to the available transport length. Each individual bridge module can be used as an individual bridge without requiring additional components such as, e.g., ramps.

The individual bridge modules are nested into each other for transport such that a very small transport height is attained.

Among the advantages of the bridge according to the present invention are small transport dimensions at a large structural height; no ramps or ramp angles are required due to the plane roadway; adequate visibility of the bridge for vehicles entering or crossing the bridge; short bridges and central sections are identical, meaning that large bridges may be constructed of several small bridges.

In order to reduce the width for transport, the lateral parts of the bridge consisting of the side walls and the roadway slabs are pushed together. According to an additional preferred embodiment of the present invention, the central roadway slabs are initially folded on the outer regions of the roadway perpendicular to the roadway direction, and both lateral parts of the bridge are subsequently pushed together.

The individual bridge elements may be connected with each other via a bolt or a hammer coupling. Sections of installation beams and/or transverse girders may be accommodated in the upper bridge module of the stack so as to reduce the transport space.

In further embodiment in which the lateral part of the individual modules are pushed together for transport purposes, the bridge is installed advantageously module-by-module from bottom to top.

In still other embodiments in which the lateral parts of the bridge are not pushed together for transport purposes, the bridge is installed advantageously module-by-module from top to bottom.

BRIEF DESCRIPTION OF THE DRAWINGS

These and other objects, features and advantages of the present invention will become more readily apparent from the following detailed description when taken in conjunction with the accompanying drawings wherein.

DETAILED DESCRIPTION OF THE DRAWINGS

Figure 1:
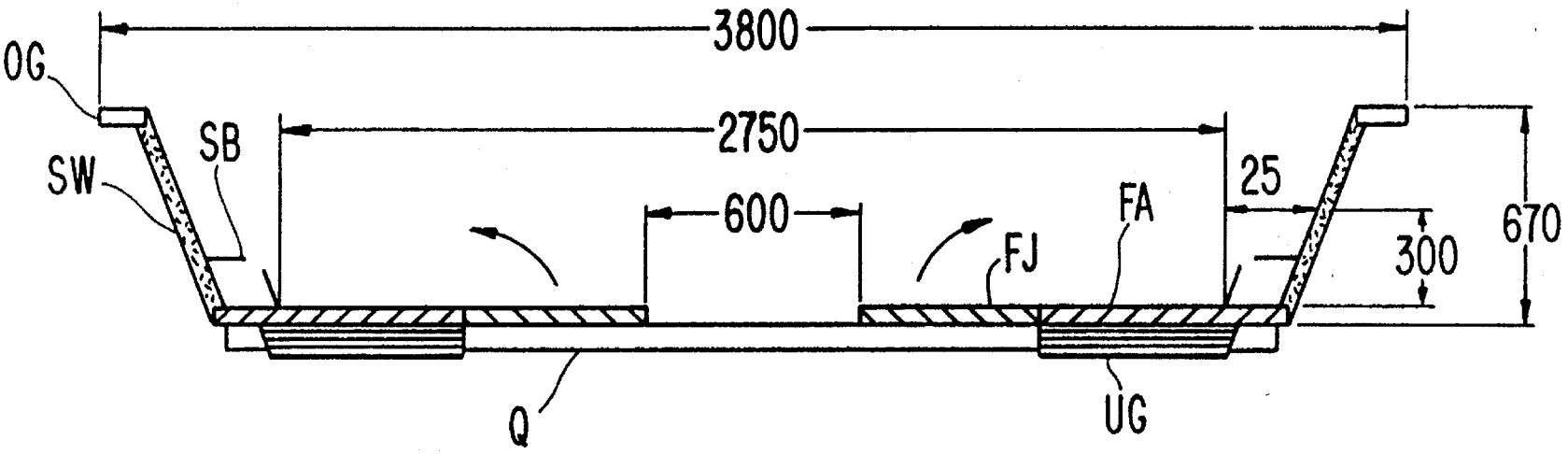
FIG. 1 is a cross-sectional view of a bridge according to the present invention.

FIG. 1 shows a cross-section through a trough bridge having a plane roadway. Exemplary numerical dimensions are provided. The bridge also comprises two side walls SW which extend upward at the edges of the roadway at an angle of greater than or equal to (≧) 90° with the roadway. The top chords OG extend outwardly in the upper edge region of the side walls SW. The left and the right portions of the plane roadway comprise the bottom chords which are constructed as outer roadway slabs FA and are adjoined by two additional inner roadway slabs FI which are connected with the outer roadway slabs FA via articulated joints or hinges. The inner roadway slabs FI may be folded upward/outward at the hinges perpendicular to the roadway direction, so that the inner roadway slabs FI lie on the bottom chords/outer roadway slabs FA. A transverse girder Q connects the two lateral parts of the bridge consisting of the top chord OG, the side wall SW, and the two roadway slabs FI, FA which are connected via articulated joints. A guardrail SB may be arranged advantageously at the outer regions of the roadway. In addition to the illustrated arrangement in which a distance exists between the inner roadway slabs, it is also possible to construct the bridge so that said inner roadway slabs directly adjoin each other.

Figure 2:
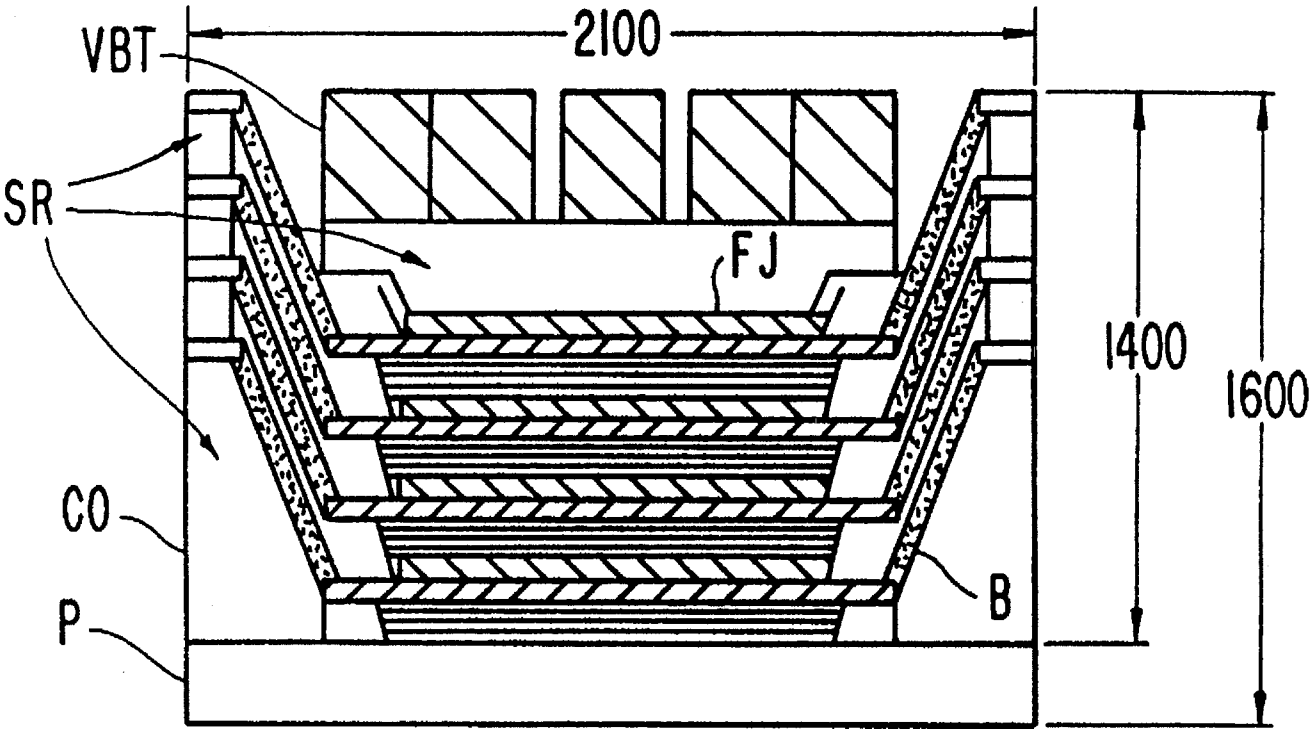
FIG. 2 is a cross-sectional view of a stack of bridge modules prepared for transport.
Figure 3:
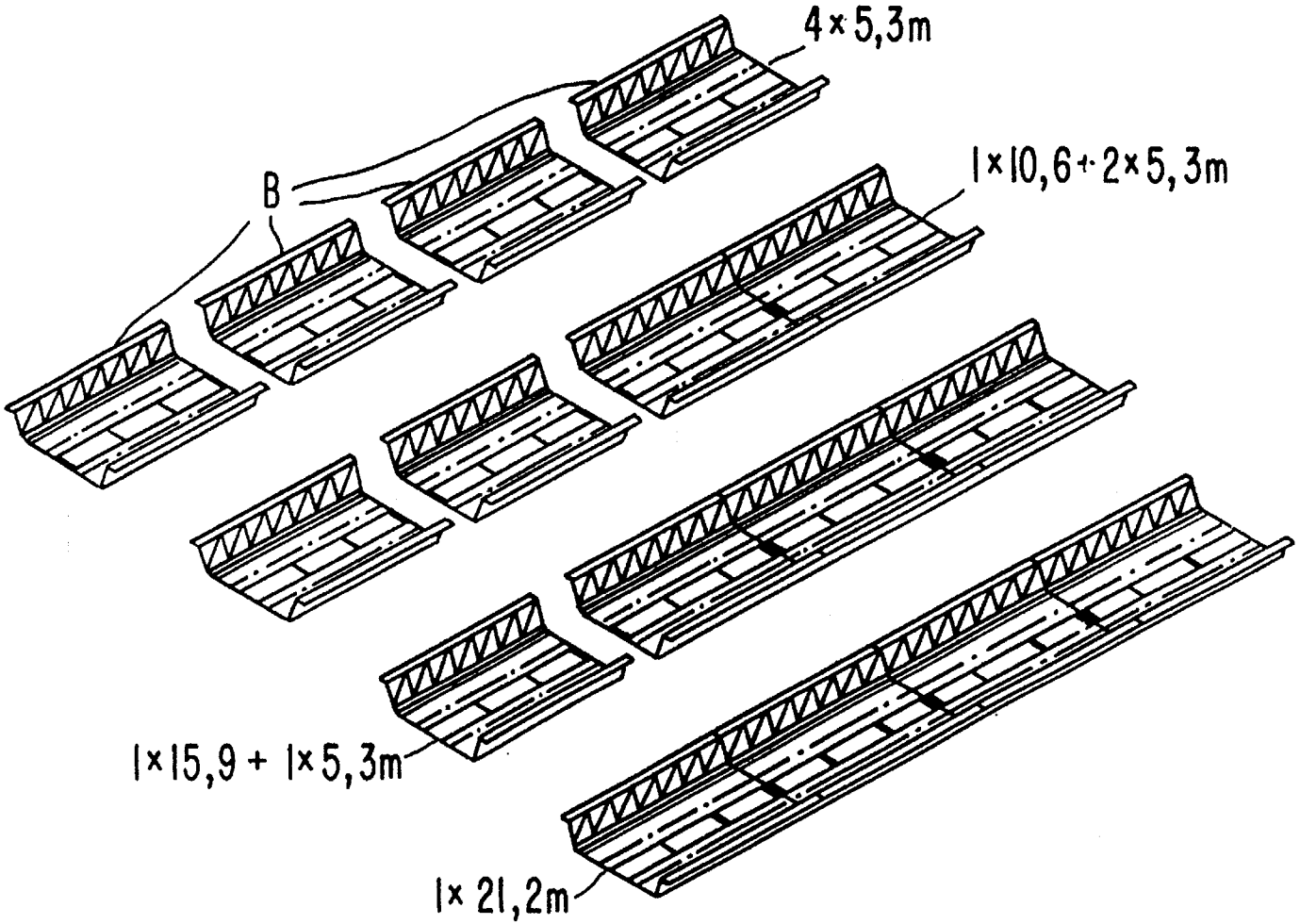
FIG. 3 is a perspective view of several bridges of different length according to the present invention.

FIG. 2 shows the bridge in a transport condition in which the individual bridge modules B of the type illustrated in FIG. 1 are stacked on top of each other on a pallet P inside of a container CO, namely a way such that the individual modules are nested in each other. The transverse girders Q were previously removed, and the inner roadway slabs FI were folded toward the outside such that they lie on the bottom chords FA in order to reduce the width for transport. The lateral parts, which are separated from each other after the aforementioned; folding process, have been pushed together. Sufficient storage space SR exists for the installation beams VBT in the upper module of the stack. Additional intermediate spaces SR which result between the individual modules or between the stack and the container walls may be used for accommodating the transverse girders Q. The bridge according to the present invention consists of individual bridge modules B which can each also be used as an individual bridge. This modular structure provides a high flexibility for using the bridge. Some examples for using this bridge are illustrated in FIG. 3 in which the four illustrated bridge modules can be used separately or can be combined to form larger bridges to achieve the desired length. Additional bridge parts, e.g., ramp components, are thus not required.

Figure 4:
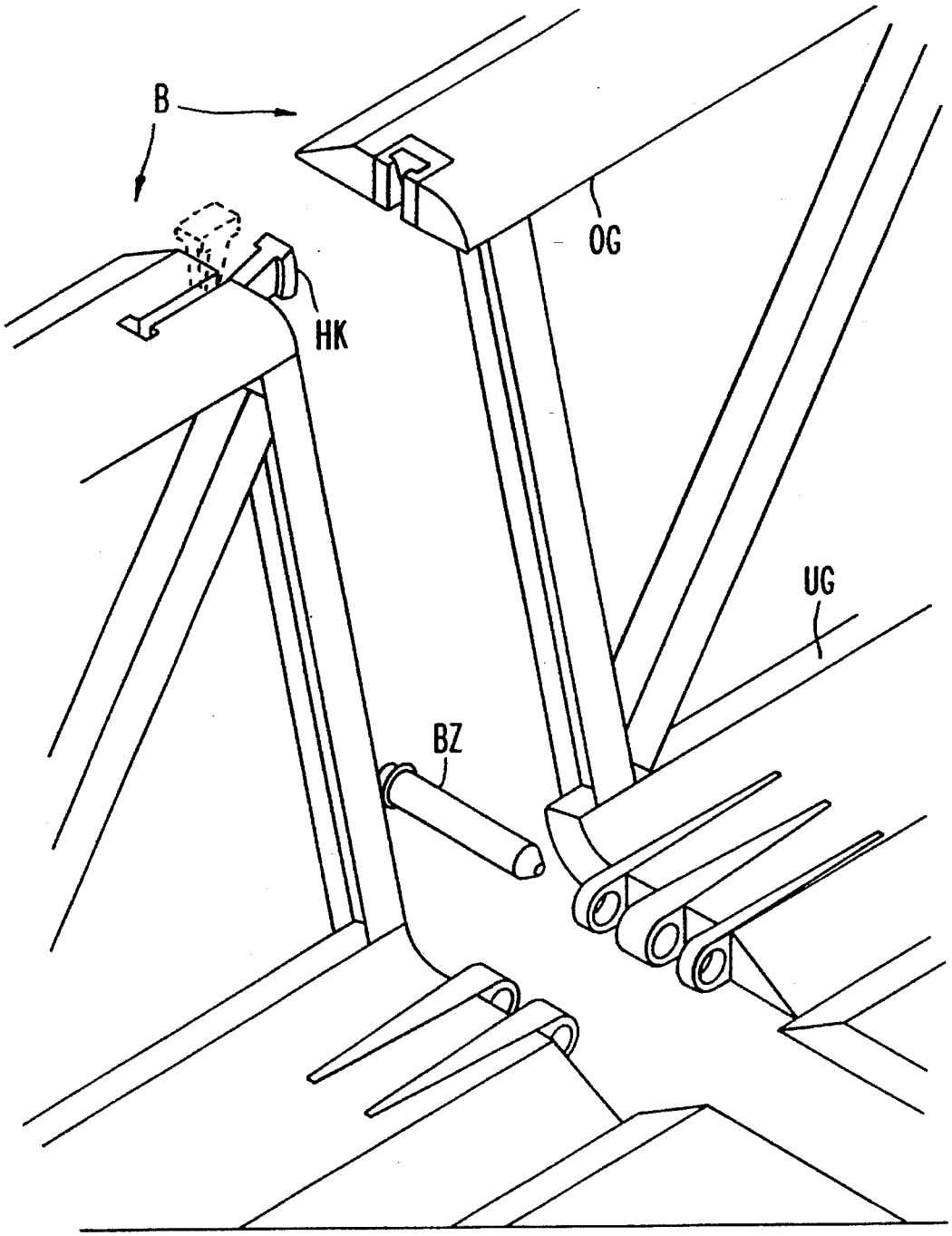
FIG. 4 is a perspective partial view of the connection between the bridge modules by way of bolts.
Figure 5:
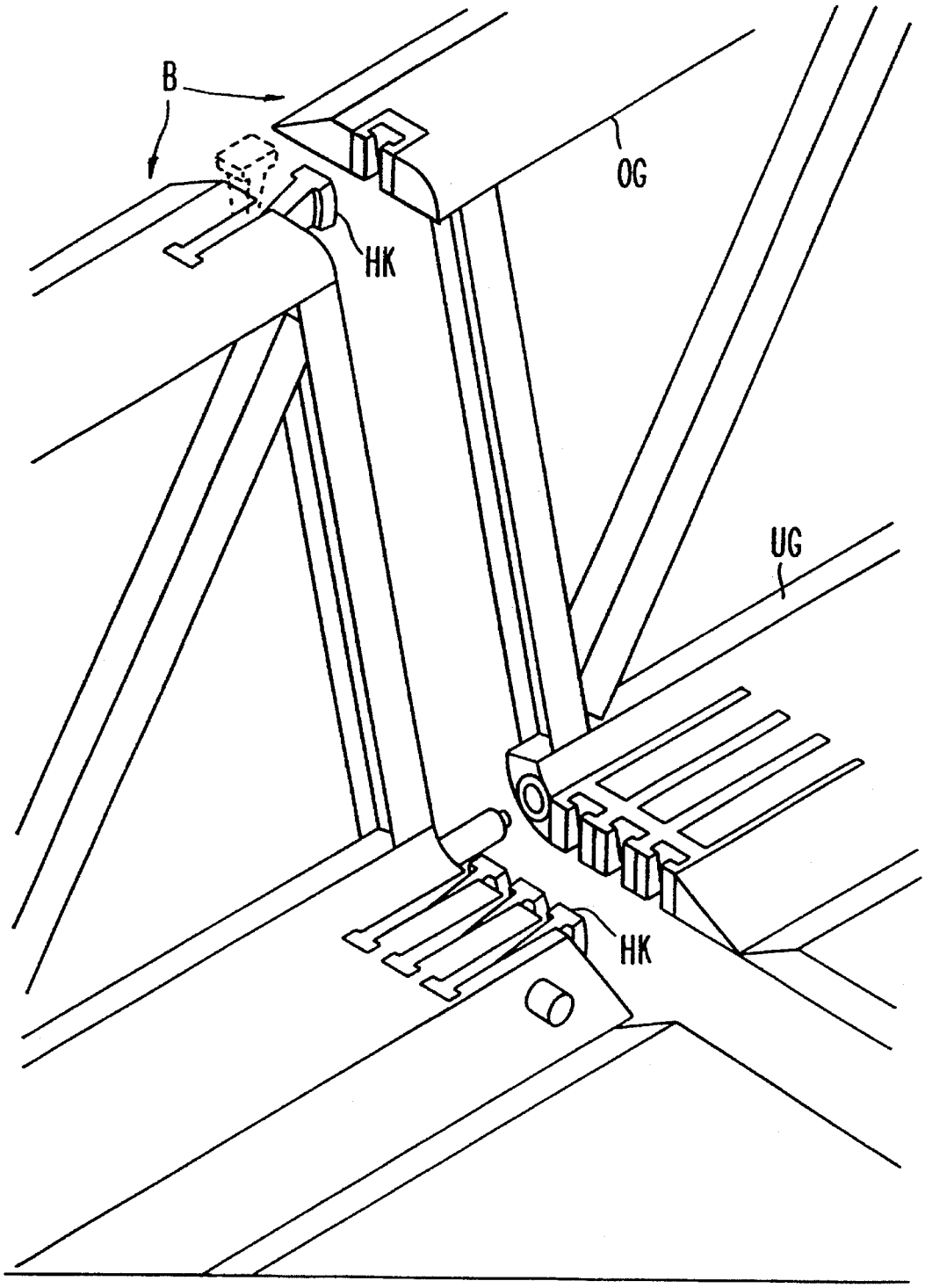
FIG. 5 is a perspective partial view similar to FIG. 4 but of the connection between the bridge modules by way of hammer couplings.

The individual modules may be connected with each other via bolts and/or hammer couplings. In the embodiment according to FIG. 4, the bridge modules B are connected via a bolt BZ at the bottom chord UG, while hammer couplings HK are used at the top chord OG. In the alternative embodiments according to FIG. 5, the bridge modules B are connected by hammer couplings HK at the top as well as the bottom chord OG, UG.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A trough bridge, comprising a plane roadway and upward extending side walls, upper ends of the side walls having top chords arranged thereat, said bridge being dividingly configured along a roadway direction into a number of individual modules so as to be nestable in each other for transport to provide a nested stack with a minimized transport height.

2. The trough bridge according to claim 1, wherein lateral parts of the bridge are configured to be pushed toward each other so as to reduce bridge width for transport.

3. The trough bridge according to claim 1, wherein inner roadway slabs comprising the plane roadway are folded on outer regions of the plane roadway in a direction of the side walls, and lateral parts of the bridge are configured to be pushed toward each other to reduce bridge width for transport.

4. The trough bridge according to claim 1, wherein each of the individual modules are configured to be usable as an individual bridge without additional components.

5. The trough bridge according to claim 1 wherein the individual bridge modules are connected with each other via at least one of bolts and hammer couplings.

6. The trough bridge according to claim 1, wherein sections of installation beams or transverse girders are stored in an upper bridge module of the stack.

7. The trough bridge according to claim 5, wherein the individual modules are configured to be used as individual bridges without additional components.

8. The trough bridge according to claim 7, wherein the individual bridge modules are connected with each other via at least one of bolts and hammer couplings.

* * * * *